US005672579A

United States Patent [19]

Diaz et al.

[11] Patent Number: 5,672,579

[45] Date of Patent: Sep. 30, 1997

[54] WATER BASED DIMETHYL ESTER CLEANING SOLUTION

[75] Inventors: Iris Margarita Diaz, Springfield; Joel Jeffry Gummeson, Belchertown; Mark Weir Heininger, Springfield, all of Mass.

[73] Assignee: Monsanto Company, St. Louis, Mo.

[21] Appl. No.: 607,252

[22] Filed: Mar. 4, 1996

Related U.S. Application Data

[63] Continuation of Ser. No. 383,625, Feb. 6, 1995, abandoned.

[51] Int. Cl.[6] ..... C11D 7/26; C11D 7/50

[52] U.S. Cl. ..... 510/405; 510/118; 510/181; 510/182; 510/202; 510/206; 510/215; 510/242; 510/245; 510/254; 510/365; 510/505; 510/200; 510/203; 252/364

[58] Field of Search ..... 252/162, 170, 252/171, 173, DIG. 8, 364; 134/38, 40; 510/405, 118, 181, 182, 202, 206, 215, 242, 245, 254, 365, 505, 200, 203

[56] References Cited

U.S. PATENT DOCUMENTS

| | | | |
|---|---|---|---|
| 4,328,256 | 5/1982 | Romero-Sierra | 427/4 |
| 4,333,845 | 6/1982 | Garner | 252/170 |
| 4,780,235 | 10/1988 | Jackson | 252/170 |
| 5,002,078 | 3/1991 | Kaes | 134/42 |
| 5,004,509 | 4/1991 | Bristol | 148/23 |
| 5,062,988 | 11/1991 | Dishart et al. | 252/170 |
| 5,084,200 | 1/1992 | Dishart et al. | 252/173 |
| 5,089,164 | 2/1992 | Stanley | 510/213 |
| 5,230,821 | 7/1993 | Larson et al. | 252/170 |
| 5,334,255 | 8/1994 | James | 134/38 |
| 5,354,492 | 10/1994 | Short | 252/162 |
| 5,415,800 | 5/1995 | Motsenbocker | 252/170 |

FOREIGN PATENT DOCUMENTS

| | | | |
|---|---|---|---|
| 0389829 | 10/1990 | European Pat. Off. . | |
| 648820 | 4/1995 | European Pat. Off. . | |
| 57-83598 | 5/1982 | Japan . | |
| 93/18101 | 9/1993 | WIPO | 252/170 |

OTHER PUBLICATIONS

Santosol™ Dimethyl Esters; Pub. No. 2149204.

*Primary Examiner*—Douglas J. McGinty
*Attorney, Agent, or Firm*—Michael J. Murphy

[57] ABSTRACT

A cleaning solution consisting essentially of dimethyl ester, water and one or more organic solvents completely miscible at 23° C. with dimethyl ester and water, said water present at at least ten weight percent based on the weight of solution components.

3 Claims, No Drawings

WATER BASED DIMETHYL ESTER CLEANING SOLUTION

This is a Continuation of application Ser. No. 08/383,625, filed on Feb. 6, 1995, now abandoned.

BACKGROUND OF THE INVENTION

This invention relates to a cleaning solution and more particularly to a cleaning solution which, after cleaning a surface, can be rinsed away with water without leaving a film.

Cleaning compositions for removing contaminants from substrates which contain commercially available dibasic ester solvent are disclosed in U.S. Pat. No. 5,084,200, issued Jan. 28, 1992. Such patent recognizes it to be desirable to flush the cleansed substrate surface without leaving a residual film from the cleaning agent thereon. As therein disclosed, however, such compositions typically contain a compatabilizing surfactant or emulsifier which, when present, can contaminate the cleansed surface after rinsing in that residual emulsifier might undesirably absorb water or react with component(s) of an industrial coating applied to the cleansed surface. It would be desirable to provide cleaning compositions of dibasic ester and water which are free of a compatabilizing emulsifier component.

SUMMARY OF THE INVENTION

Now cleaning composition improvements have been made which obviate emulsifiers in dibasic ester cleaning compositions.

Accordingly, a principal object of this invention is to provide a cleaning composition which includes dibasic ester and water which does not rely for cleaning effectiveness on the presence of emulsifier.

Other objects will in part be obvious and in part appear hereinafter.

These and other objects are accomplished by providing a cleaning solution consisting essentially of dimethyl ester, water and one or more organic solvents completely miscible at 23° C. with dimethyl ester and water, such water being present at at least ten weight percent based on the weight of solution components. Isopropanol as solvent and a solution containing it with about 39% water are preferred.

DETAILED DESCRIPTION OF THE INVENTION

The dimethyl ester component of the cleaning solution comprises dimethyl adipate or dimethyl glutarate or dimethyl succinate and preferably is a blend or mixture of two or all three of such esters. When a mixture is used the respective amounts are not considered critical and commercially available mixtures are usable directly. A representative mixture comprises 15 to 25% (by weight) dimethyl succinate, 55–75% dimethyl glutarate and 20–25% dimethyl adipate. The noted preferred blend per se desirably evaporates slowly at room temperature and atmospheric pressure but does not mix well with water, dissolving only about 3.6 weight % $H_2O$ at room temperature. Purified and mixed grades of these esters are available from Monsanto Company under the trademark Santosol.

The solvent component of the cleaning solution is miscible in the dimethyl ester component at 23° C. and is selected from $C_1$ to $C_3$ monohydric alcohols, propylene glycol methyl ether, diethylene glycol n-butyl ether, ethylene glycol, n-butyl ether ethylene glycol, propylene glycol, triglycols, acetone, diethylene glycol monoethyl acetate and mixtures of any one or more of the foregoing.

The third component is water at a level in the solution of at least ten weight percent.

Preferred solution compositions comprise 10 to 85% dimethyl ester mixture (DME) 11 to 25% isopropanol and 16 to 66% water, most preferably, 20 to 40% DME, 18 to 22% isopropanol and 38 to 62% water. A particularly preferred solution maximizing water and DME is about 39% DME, about 22% isopropanol and about 39% water.

The cleaning solution of the invention is usable where water, soap solution or conventional solvents do not work well. It is fully rinsable with water whereas conventional pure DME's or DME blends are not. The invention solution is quite suitable for applications where surfactant contamination must be avoided. The preferred composition noted above is also low cost and environmentally safe. It can be used to remove adhesives, gum, paint, oil, grease and a variety of other surface contaminants. It is particularly useful in cleaning substrates such as glass, metal, wood and many plastics but not recommended for prolonged contact with some plastics such as highly plasticized polyvinyl chloride. It is particularly useful where a waterborne solution is preferred but the solvency of organic solvents is required.

The invention is further described in the following examples which are for illustration only and not to limit or restrict the invention. Unless otherwise indicated, parts and percentages are by weight.

EXAMPLES 1–5 AND C1–C5

Solutions (room temperature) of the blend of dimethyl esters noted above and water are prepared and then various organic solvents are added with mild agitation until some cloudiness or two phase development (droplets) occurs wherein after solvent addition, the water concentration is at the level shown in Table I which is always ten percent or more. In control Examples C1–C5, which are not within the scope of the invention, the solvent is immiscible in the DME-water solution. Y means yes and N no in Table 1. Results are as follows:

TABLE 1

| Example | Organic Solvent | Water Miscibility | Water Concentration (%) |
|---|---|---|---|
| 1 | acetic acid | Y | 18 |
| 2 | acetone | Y | 12 |
| 3 | amine (n,n'-dimethyl ethanol amine) | Y | 14 |
| 4 | glycol monopropyl ether | Y | 22 |
| 5 | isopropanol | Y | 39 |
| C1 | ammonia | N | — |
| C2 | formaldehyde | N | — |
| C3 | isobutanol | N | — |
| C4 | methyl ethyl ketone | N | — |
| C5 | methyl isobutyl ketone | N | — |

EXAMPLES 6–14

Various surface contaminants are deposited on various substrates. A solution of 39% DME blend, 39% water and 22% isopropanol according to the invention is manually poured on the contaminated substrate and then rubbed with cheese cloth to remove the contaminant. After contaminant removal, residual cleaning solution is completely removed by rinsing the substrate with a cheese cloth saturated with water. The various contaminants and substrates are as follows:

| Example | Substrate | Contaminant |
|---|---|---|
| 6 | tile floor | melamine formaldehyde crosslinking resin |
| 7 | phenolic lab bench top | automotive base coat paint |
| 8 | metal chair | as in Ex. 6 |
| 9 | stainless steel (unpolished) | residual cutting oil |
| 10 | human finger nail | nail polish |
| 11 | polished stainless steel | adhesive tape residue |
| 12 | glass | nail polish |
| 13 | steel plate | gum |
| 14 | steel plate | dry, uncrosslinked automotive base coat paint |

The preceding description is for illustration and should not be taken as limiting. Various modifications and alterations will be readily suggested to persons skilled in the art. It is intended, therefore, that the foregoing be considered as exemplary only and that the scope of the invention be ascertained from the following claims.

We claim:

1. A cleaning solution free of surfactant or emulsifier consisting essentially of, on a weight basis: i) 10 to 85% of a mixture of dimethyl adipate, dimethyl glutarate and dimethyl succinate; ii) 16 to 66% water; and iii) 11 to 25% of isopropanol.

2. The solution of claim 1 wherein the solution contains about 39% water.

3. The solution of claim 1 wherein the percent ranges of components i), ii) and iii) are respectively 20 to 40%; 38 to 62% and 18 to 22%.

* * * * *